US010077413B2

(12) United States Patent
Walker et al.

(10) Patent No.: US 10,077,413 B2
(45) Date of Patent: Sep. 18, 2018

(54) LUBRICATING COMPOSITION CONTAINING A DETERGENT

(71) Applicant: The Lubrizol Corporation, Wickliffe, OH (US)

(72) Inventors: Gary M. Walker, Allestree (GB); Ewan E. Delbridge, Concord Township, OH (US); Yanshi Zhang, Solon, OH (US); Edward P. Sampler, Leicestershire (GB); Stephen J. Cook, Belper (GB); Christopher L. Friend, Nottingham (GB); Mohamed G. Fahmy, Eastlake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/910,934

(22) PCT Filed: Aug. 11, 2014

(86) PCT No.: PCT/US2014/050505

§ 371 (c)(1),
(2) Date: Feb. 8, 2016

(87) PCT Pub. No.: WO2015/023575

PCT Pub. Date: Feb. 19, 2015

(65) Prior Publication Data

US 2016/0208189 A1 Jul. 21, 2016

Related U.S. Application Data

(60) Provisional application No. 61/866,055, filed on Aug. 15, 2013.

(51) Int. Cl.

| | |
|---|---|
| ***C10M 163/00*** | (2006.01) |
| ***C10M 161/00*** | (2006.01) |
| ***C10M 159/20*** | (2006.01) |
| ***C10M 165/00*** | (2006.01) |
| ***C10M 129/10*** | (2006.01) |
| ***C10M 135/10*** | (2006.01) |
| ***C10M 145/24*** | (2006.01) |

(52) U.S. Cl.

CPC ..... *C10M 161/00* (2013.01); *C10M 129/10* (2013.01); *C10M 135/10* (2013.01); *C10M 145/24* (2013.01); *C10M 159/20* (2013.01); *C10M 165/00* (2013.01); *C10M 2203/1025* (2013.01); *C10M 2205/022* (2013.01); *C10M 2205/04* (2013.01); *C10M 2207/024* (2013.01); *C10M 2207/026* (2013.01); *C10M 2207/028* (2013.01); *C10M 2207/262* (2013.01); *C10M 2209/102* (2013.01); *C10M 2209/103* (2013.01); *C10M 2209/104* (2013.01); *C10M 2209/108* (2013.01); *C10M 2215/064* (2013.01); *C10M 2215/28* (2013.01); *C10M 2219/046* (2013.01); *C10M 2223/045* (2013.01); *C10N 2210/01* (2013.01); *C10N 2210/02* (2013.01); *C10N 2230/04* (2013.01); *C10N 2230/10* (2013.01); *C10N 2230/12* (2013.01); *C10N 2230/52* (2013.01); *C10N 2240/10* (2013.01)

(58) Field of Classification Search

CPC ..... C10M 2219/046
USPC ..... 508/398
See application file for complete search history.

(56) References Cited

U.S. PATENT DOCUMENTS

| | | | |
|---|---|---|---|
| 2,620,302 | A | 12/1952 | Harle et al. |
| 2,620,304 | A | 12/1952 | Stewart et al. |
| 2,620,305 | A | 12/1952 | Stewart et al. |
| 2,681,315 | A | 6/1954 | Tongberg et al. |
| 2,833,717 | A | 5/1958 | Whitacre et al. |
| 2,921,027 | A | 1/1960 | Brennan et al. |
| 3,933,662 | A | 1/1976 | Lowe et al. |
| 4,305,835 | A | 12/1981 | Barber et al. |
| 4,402,845 | A | 9/1983 | Zoleski et al. |
| 4,438,005 | A | 3/1984 | Zoleski et al. |
| 4,479,882 | A | 10/1984 | Zoleski et al. |
| 4,493,776 | A | 1/1985 | Rhodes et al. |
| 4,973,414 | A | 11/1990 | Merger et al. |
| 5,397,486 | A | 3/1995 | Small et al. |
| 2011/0162260 | A1* | 7/2011 | MacDuff ..... C10L 1/023 44/385 |

FOREIGN PATENT DOCUMENTS

| | | | |
|---|---|---|---|
| CN | 102888263 | A | 1/2013 |
| EP | 0410648 | A2 | 1/1991 |
| EP | 1705236 | A2 | 9/2006 |
| GB | 835682 | A | 5/1960 |
| WO | 2012097026 | A1 | 7/2012 |

* cited by examiner

*Primary Examiner* — Vishal Vasisth
(74) *Attorney, Agent, or Firm* — Michael Miller; Teresan Gilbert

(57) ABSTRACT

The invention provides a process to prepare a detergent in the presence of a polyether compound. The invention further provides for a lubricating composition containing the detergent. The invention further relates to the use of the lubricating composition in a mechanical device such as an internal combustion engine.

16 Claims, No Drawings

LUBRICATING COMPOSITION CONTAINING A DETERGENT

CROSS REFERENCE TO RELATED APPLICATION

This application claims priority from PCT Application Serial No. PCT/US2014/050505 filed on Aug. 11, 2014, which claims the benefit of U.S. Provisional Application No. 61/866,055 filed on Aug. 15, 2013, the entirety of both of which is hereby incorporated by reference.

FIELD OF INVENTION

The invention provides a process to prepare a detergent in the presence of a polyether compound. The invention further provides for a lubricating composition containing the detergent. The invention further relates to the use of the lubricating composition in a mechanical device such as an internal combustion engine.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on mechanical devices (such as internal combustion engines). Harmful effects may include possible wear (in both iron and aluminium based components), bearing corrosion, increased acid accumulation (due to lack of neutralisation of combustion by-products), or increased deposit formation, or a reduction in fuel economy.

In terms of controlling deposits, the lubricant industry has a number of engine tests used to evaluate lubricant's ability to handle deposits and sludge including the Sequence VG, Sequence IIIG, Volkswagen TDI, Caterpillar 1N, and Mercedes Benz OM501LA. With recent changes to engine specifications there is an increasing demand on the lubricant to reduce deposits. For instance, the ILSAC GF-5 specification requires a 4.0 piston merit rating in the Sequence IIIG (vs. 3.5 for GF-4).

U.S. Pat. No. 3,933,662 (Lowe, published 20 Jan. 1976) discloses mono-ester polyalkoxylated compounds combined with alkaline earth metal carbonates dispersed in a hydrocarbon medium to provide lubricating compositions of superior acid neutralizing capability and rust inhibition in internal combustion engines. The internal combustion engine tested is a Sequence IIB engine. The Sequence IIB engine test evaluates valve guide rust and pitting. U.S. Pat. No. 3,933,662 does not disclose incorporation of mono-ester polyalkoxylated compounds into the process to prepare the alkaline earth metal carbonates dispersed in a hydrocarbon medium.

Numerous references teach a variety of polyalkylene glycol type compounds in lubricants. For example U.S. Pat. No. 4,305,835 (Barber et al, published 15 Dec. 1981); U.S. Pat. No. 4,402,845 (Zoleski et al., published 6 Sep. 1983); U.S. Pat. No. 4,438,005 (Zoleski et al., published 20 Mar., 1984); U.S. Pat. No. 4,479,882 (Zoleski et al., published 30 Oct., 1984); U.S. Pat. No. 4,493,776 (Rhodes, published 15 January, 1985); U.S. Pat. No. 4,973,414 (Nerger et al., published 27 Nov., 1990); U.S. Pat. No. 5,397,486 (Small, published 14 Mar., 1995); U.S. Pat. No. 2,681,315 (Tongberg, published 15 Jun., 1954); U.S. Pat. No. 2,833,717 (Whitacre, published 6 May, 1958); U.S. Pat. No. 2,921,027 (Brennan 12 Jan., 1960); U.S. Pat. No. 2,620,302 (Harle, published 2 Dec. 1952), U.S. Pat. No. 2,620,304 (Stewart et al., published 2 Dec., 1952), and U.S. Pat. No. 2,620,305 (Stewart et al., published 2 Dec., 1952). None of the references disclose incorporation of polyalkoxylated compounds into the process to prepare the detergents disclosed within each reference.

SUMMARY OF THE INVENTION

The objectives of the present invention include to provide a detergent capable of at least one of reducing corrosion, reducing wear, reducing oxidation (for example oxidative stability), friction control (typically reducing friction to increase fuel economy), reducing soot deposits and reducing acid build up (or may alternatively be defined as TBN retention). The detergent may be particularly useful at controlling soot deposits and/or acid build up.

As used herein reference to the amounts of additives present in the lubricating composition disclosed herein are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

In one embodiment the present invention provides a process for preparing a metal-containing detergent that has incorporated into it a polyether compound, the process comprising the steps of:

(a) forming/providing a detergent substrate in the presence of a polyether compound; and (b) neutralising the detergent substrate of step (a) with a metal-containing base to form a neutral metal-containing detergent soap.

In one particular embodiment the present invention provides a process for preparing a metal-containing detergent that has incorporated into it a polyether compound, the process comprising the steps of:

(a) forming/providing a detergent substrate;

(b) contacting the detergent substrate of step (a) with a polyether compound; thereafter neutralising the detergent substrate with a metal-containing base to form a neutral metal-containing detergent soap.

In one particular embodiment the present invention provides a process for preparing a metal-containing detergent that has incorporated into it a polyether compound, the process comprising the steps of:

(a) forming/providing a detergent substrate; and (b) neutralising the detergent substrate of step (a) with a metal-containing base in the presence of a polyether compound to form a neutral metal-containing detergent soap, with the proviso that at least 50 mol % of the polyether compound is added before 75% of neutralizing is complete The processes described above may optionally further comprise overbasing the neutral metal-containing detergent soap to form an overbased detergent. In one embodiment each process described above further comprises overbasing the neutral metal-containing detergent soap to form an overbased detergent.

In one particular embodiment the present invention provides a process for preparing a metal-containing detergent that has incorporated into it a polyether compound, the process comprising the steps of:

(a) forming/providing a detergent substrate;

(b) neutralizing the detergent substrate of step (a) with a metal-containing base to form a neutral metal-containing detergent soap; and (c) overbasing the neutral metal-containing detergent soap of step (b) to form an overbased detergent, in the presence of a polyether compound, with the proviso that at least 50 mol % of the polyether compound is added before 75% of overbasing is complete.

The proviso that at least 50 mol % of the polyether compound is added before 75% of overbasing is complete ensures that the process results in the metal-containing detergent incorporating the polyether into the structure of the detergent. Without being bound by theory the polyether may be located within the micelle, bonded to the detergent substrate or incorporated into the metal containing portion (typically a metal carbonate enclosed within the detergent micelle. As a result it may in some instances be possible to add more than 50 mol % of the polyether compound after 75% of overbasing is complete, however, the skilled person will realize that the overbasing procedure would need to be slowed down or otherwise modified to ensure that the polyether compound has sufficient time to be incorporated into the metal-containing detergent.

Typically 75 mol % or more, or 85 mol % or more, or 95 mol % to 100 mol % of the polyether compound is added before overbasing is 75% complete, or before overbasing is 65% complete.

For the same reasons, when preparing a neutral metal-containing detergent by contacting the polyether compound with the detergent substrate once neutralizing has commenced by a process outlined above it is preferably to add the polyether compound before neutralization is complete.

Typically the detergent of the present invention may be an overbased detergent.

The detergent substrate may comprise a hydrocarbyl-substituted phenol (typically an alkyl phenol), or a sulphur-bridged alkyl phenol, or a methylene coupled alkyl phenol forming a phenate detergent. The phenate detergent may have a TBN of 120 to 450, or 150 to 200, or 200 to 300 mg KOH/g.

The detergent substrate may also comprise a hydrocarbyl-substituted sulphonic acid (typically an alkyl benzene sulphonic acid), or a hydrocarbyl-substituted sulphonic acid (typically an alkyl naphthylene sulphonic acid), or mixtures thereof forming a sulphonate detergent. The sulphonate detergent has a TBN of 250 to 650, or 300 to 550, or 300 to 500 mg KOH/g.

In one embodiment the present invention provides a process to prepare a phenate detergent, typically an overbased phenate detergent with a TBN of 150 to 200, or 200 to 300 mg KOH/g.

The oil medium may be the same as an oil of lubricating viscosity, as is described below.

The invention may also provide for a product obtained/obtainable by the process described herein.

The invention may also provide for a lubricating composition comprising an oil of lubricating viscosity and a product obtained/obtainable by the process described herein.

In one embodiment the invention provides for a method of lubricating a mechanical device with a lubricating composition disclosed herein. The mechanical device may be an internal combustion engine.

The internal combustion engine may have a steel surface on at least one of a cylinder bore, cylinder block, or piston ring.

The internal combustion engine may have an aluminium alloy, or aluminium composite surface on at least one of a cylinder bore, cylinder block, or piston ring.

In one embodiment the invention provides for the use of a detergent of the present invention as also providing at least one of reduced corrosion, reduced wear, reduced soot deposits, friction control, and reduced acid build up (or may alternatively be defined as TBN retention).

In one embodiment the invention provides for the use of a detergent of the present invention as also providing reduced soot deposits, friction control, and reduced acid build up performance in a lubricating composition for an internal combustion engine.

The product obtained/obtainable by the process described herein may be present in the range of 0.01 wt % to 8 wt %, or 0.1 wt % to 6 wt %, or 0.15 wt % to 5 wt %, or 0.2 wt % to 3 wt % of the lubricating composition. of the lubricating composition. In one embodiment the compound may be present at 0.2 wt % to 3 wt % of the lubricating composition.

DETAILED DESCRIPTION OF THE INVENTION

The present invention provides a detergent, a process to prepare a detergent, a lubricating composition, a method for lubricating a mechanical device and a use as disclosed above.

Metal-Containing Base

The metal-containing base is used to supply basicity to the detergent. The metal-containing base is a compound of a hydroxide or oxide of the metal. Within the metal compound, the metal is typically in the form of an ion. The metal may be monovalent, divalent, or trivalent. When monovalent, the metal ion M may be an alkali metal, when divalent, the metal ion M may be an alkaline earth metal, and when trivalent the metal ion M may be aluminium. The alkali metal may include lithium, sodium, or potassium, or mixtures thereof, typically sodium. The alkaline earth metal may include magnesium, calcium, barium or mixtures thereof, typically calcium or magnesium.

Examples of metal basic compounds with hydroxide functionality include lithium hydroxide, potassium hydroxide, sodium hydroxide, magnesium hydroxide, calcium hydroxide, barium hydroxide and aluminium hydroxide. Suitable examples of metal basic compounds with oxide functionality include lithium oxide, magnesium oxide, calcium oxide and barium oxide. The oxides and/or hydroxides can be used alone or in combination. The oxides or hydroxides may be hydrated or dehydrated, although hydrated is typical (for calcium, at least). In one embodiment the metal-containing base may be calcium hydroxide, which may be used alone or mixtures thereof with other metal basic compounds. Calcium hydroxide is often referred to as lime. In one embodiment the metal-containing base may be calcium oxide which can be used alone or mixtures thereof with other metal basic compounds.

Detergent Substrate

In different embodiments the process of the invention forms a neutral detergent, or an overbased detergent. In one embodiment the process described herein provides a product that may be described as "overbased". The expression "overbased" is known to a person skilled in the art.

Overbased materials, otherwise referred to as overbased or superbased salts, are generally single phase, homogeneous Newtonian systems characterised by a metal content in excess of that which would be present for neutralisation according to the stoichiometry of the metal and the particular acidic organic compound reacted with the metal.

The amount of metal is commonly expressed in terms of substrate to metal ratio. The terminology "metal ratio" is used in the prior art and herein to designate the ratio of the total chemical equivalents of the metal in the overbased salt to the chemical equivalents of the metal in the salt which would be expected to result in the reaction between the hydrocarbyl-substituted organic acid; the hydrocarbyl-substituted phenol or mixtures thereof to be overbased and the basically reacting metal compound according to the known chemical reactivity and stoichiometry of the two reactants. Thus, in a normal or neutral salt the metal ratio is one and, in an overbased salt, the metal ratio is greater than one. The overbased metal salt of the hydrocarbyl-substituted organic acid; the hydrocarbyl-substituted phenol or mixtures thereof used in this invention usually have metal ratios not exceeding 40:1 (or 40). Often, salts having ratios of 2:1 to 35:1 are used. Such overbased materials are well known to those skilled in the art. Patents describing techniques for making basic salts of sulphonic acids, carboxylic acids, phenols, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

A more detailed description of the expressions "metal ratio", TBN and "soap content" are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification.

The detergent may be formed by the reaction of the metal-containing base, and a detergent substrate. The detergent substrate may include an alkyl phenol, an aldehyde-coupled alkyl phenol, a sulphurised alkyl phenol, an alkyl aromatic sulphonic acid (such as, alkyl naphthalene sulphonic acid, alkyl toluene sulphonic acid or alkyl benzene sulphonic acid), an aliphatic carboxylic acid, a calixarene, a salixarene, an alkyl salicylic acid, or mixtures thereof.

Collectively, when the alkyl phenol, the aldehyde-coupled alkyl phenol, and the sulphurised alkyl phenol are used to prepare a detergent, the detergent may be referred to as a phenate.

As used herein the TBN values quoted and associated range of TBN is on "an as is basis" i.e., containing conventional amounts of diluent oil which is used to handle viscosity. Conventional amounts of diluent oil typically range from 30 wt % to 60 wt % (often 40 wt % to 55 wt %) of the detergent component.

The TBN of a phenate may vary from less 200, or 30 to 175 (typically 155 mg KOH/g for a neutral phenate to 200 or more to 500, or 210 to 400 (typically 250-255) mg KOH/g for an overbased phenate.

The alkyl group of a phenate (i.e., an alkyl phenate) may contain 4 to 80, or 6 to 45, or 8 to 20, or 9 to 15 carbon atoms.

When the detergent is formed, the common nomenclature for the neutral or overbased detergent is a sulphonate (from aromatic sulphonic acid, typically a benzene sulphonic acid), or a phenate (from alkyl phenol, aldehyde-coupled alkyl phenol, sulphurised alkyl phenol).

In one embodiment the detergent may be a sulphonate, or mixtures thereof. The sulphonate may be prepared from a mono- or di-hydrocarbyl-substituted benzene (or naphthalene, indenyl, indanyl, or bicyclopentadienyl) sulphonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment the hydrocarbyl-substituted sulphonic acid may include polypropene benzenesulphonic acid and $C_{16}$-$C_{24}$ alkyl benzenesulphonic acid, or mixtures thereof.

When neutral or slightly basic, a sulphonate detergent may have TBN of less than 100, or less than 75, typically 20 to 50 mg KOH/g, or 0 to 20 mg KOH/g.

When overbased, a sulphonate detergent may have a TBN greater than 200, or 300 to 550, or 350 to 450 mg KOH/g.

Chemical structures for sulphonates, and phenates detergents are known to a person skilled in the art. The standard textbook entitled "Chemistry and Technology of Lubricants", Third Edition, Edited by R. M. Mortier and S. T. Orszulik, Copyright 2010, pages 220 to 223 under the sub-heading 7.2.6 provide general disclosures of said detergents and their structures.

In one embodiment the acidic or neutralised detergent substrate comprises mixtures of at least two of said substrates. When two or more detergent substrates are used, the overbased detergent formed may be described as a complex/hybrid. Typically, the complex/hybrid may be prepared by reacting, in the presence of the metal-containing base and acidifying overbasing agent, alkyl aromatic sulphonic acid at least one alkyl phenol (such as, alkyl phenol, aldehyde-coupled alkyl phenol, sulphurised alkyl phenol) and optionally alkyl salicylic acid. A detergent substrate used to prepare a complex or hybrid may be prepared as is disclosed in WO97/46643 (also published as U.S. Pat. No. 6,429,179).

When the detergent substrate is a sulphonate, the weight ratio of the polyether (i.e., polyalkylene oxide, or polyalkylene glycol)) to detergent substrate may vary from 1:50 to 5:2, or 1:28 to 2:1, or 1:18 to 1:1.

When the detergent substrate is a phenate (including a sulphur-coupled phenate, or a sulphur-free coupled phenol), the weight ratio of the detergent substrate to polyether (i.e., polyalkylene oxide, or polyalkylene glycol)) may vary from 1:60 to 1:1, or 1:32 to 3:4, or 1:12 to 2:3.

Polyether

The polyether (i.e., polyalkylene oxide, or polyalkylene glycol)) is typically oil-soluble. The polyether (i.e., polyalkylene oxide, or polyalkylene glycol)) may be hydroxyl-terminated.

The oil soluble polyether may have up to 150, up to 100, up to 75 or up to 50 oxyalkylene groups. For example, the number of oxyalkylene groups may be range from 10 to 150, or 20 to 100, or 25 to 75 or 30 to 50.

The polyether (typically oil soluble polyether) copolymer may be obtained/obtainable from a mixture of:

(1) at least one alkylene oxide selected from the group consisting of ethylene oxide, propylene oxide, butylene oxide, pentylene oxide, hexylene oxide, heptylene oxide, and mixtures thereof; and (2) at least one alkylene oxide selected from the group consisting of octylene oxide, nonylene oxide, decylene oxide, undecylene oxide, dodecylene oxide, tridecylene oxide, tetradecylene, pentadecylene oxide, hexadecylene oxide, heptadecylene oxide, octadecylene oxide, nonadecylene oxide, eicosylene oxide, and mixtures thereof.

The polyether may be formed from the group consisting of decylene oxide, undecylene oxide, dodecylene oxide, tridecylene oxide, tetradecylene, pentadecylene oxide, hexadecylene oxide, heptadecylene oxide, octadecylene oxide, and mixtures thereof.

In one embodiment the polyether comprises (i) a portion of oxyalkylene groups derived from ethylene oxide; and (ii) a portion of oxyalkylene groups derived from an alkylene oxide containing 3 to 8 carbon atoms.

The polyether may have one or two terminal hydroxyl groups, or one terminal hydroxyl group and initiated with a mono-alcohol or a secondary amine.

In one embodiment the polyether of the present invention has one terminal hydroxyl group.

In one embodiment the polyether of the present invention has one terminal hydroxyl group; and initiated with a mono-alcohol.

The polyether copolymer may comprise units derived from Formula I described herein, or may be include pentaerythritol ethoxylates.

The polyether copolymer may comprise units derived from Formula I:

Formula I

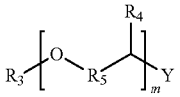

wherein:

$R_3$ may be hydrogen (H), —$R_6$OH, —$R_6NH_2$, —(C═O)$R_6$, —$R_6$—N(H)C(═O)$R_6$, or a hydrocarbyl group of from 1 to 30, or 1 to 20, or 1 to 15 carbon atoms, $R_4$ may be H, or a hydrocarbyl group of from 1 to 10 carbon atoms, $R_5$ may be a straight or branched hydrocarbyl group of from 1 to 6 carbon atoms, $R_6$ may be a hydrocarbyl group of 1 to 20 carbon atoms, Y may be $NR_7R_8$, OH, $R_6NH_2$ or $R_6$OH, $R_7$, and $R_8$, independently, may be H, or a hydrocarbyl group of from 1 to 50 carbon atoms in which up to one third of the carbon atoms may be substituted by N or functionalized with additional polyether of Formula I, and m may be an integer from 2 to 50, 3 to 40, or 5 to 30, or 10 to 25.

In another embodiment the polyether comprises (i) 0.1 wt % to 80 wt % of ethylene oxide, and an alkylene oxide containing 3 to 8 carbon atoms present at 20 wt % to 99.9 wt % of the polyether.

In a further embodiment the polyether comprises (i) 5 wt % to 60 wt % of ethylene oxide, and an alkylene oxide containing 3 to 8 carbon atoms present at 40 wt % to 95 wt % of the polyoxyalkylene glycol.

In still another embodiment the polyether comprises (i) 0 wt % to 40 wt % of ethylene oxide, and an alkylene oxide containing 3 to 8 carbon atoms present at 60 wt % to 100 wt % of the polyoxyalkylene glycol.

In a still further embodiment the polyether comprises (i) 0 wt % to 20 wt % of ethylene oxide, and an alkylene oxide containing 3 to 8 carbon atoms present at 80 wt % to 100 wt % of the polyoxyalkylene glycol.

In another embodiment the polyether comprises a homopolymer of polypropylene glycol.

In still another embodiment the polyether may be Synalox® propylene glycol. The Synalox® polyalkylene glycol is typically a homopolymer or copolymer of propylene oxide. The Synalox® polyalkylene glycol is described in more detail in a product brochure with Form No. 118-01453-0702 AMS, published by The Dow Chemical Company. The product brochure is entitled "SYNALOX Lubricants, High-Performance Polyglycols for Demanding Applications." Specific commercially available Synalox® polyalkylene glycols include 100-D450, Synalox 100-120B. Other commercially available polyalkylene glycol useful for the invention are sold under the trademark UCON™ base stocks including UCON™ LB-525, LB-625, LB-1145, and LB-1715. Examples of other available polyoxyalkylene glycol compounds include Actaclear™ ND-21 available from Bayer, Emkarox® VG-222, Emkarox® VG-127W, Emkarox® VG-132W (all Emkarox products available from Uniquema), or various oil-soluble Pluracol® products available from BASF.

In a further embodiment the polyether comprises a block (A-B-A type) copolymer of (propylene glycol-ethylene glycol-propylene glycol).

The polyether may be formed by processes known to a person skilled in the art.

In a still further embodiment the hydroxyl-capped polyoxyalkylene glycol is obtained/obtainable by a process that comprises reacting (i) an alkylene oxide, (ii) water and optionally an alcohol, and (iii) a base catalyst, by a process known to a person skilled in the art.

The hydrocarbyl-capped polyoxyalkylene glycol may be prepared by basic catalysis. U.S. Pat. Nos. 4,274,837, 4,877,416, and 5,600,025 disclose the use of alkali metals such as potassium as a basic catalyst for making hydrocarbyl-capped polyoxyalkylene glycol.

In one embodiment the hydrocarbyl-capped polyoxyalkylene glycol may be prepared using a double metal cyanide catalyst. Suitable double cyanide catalysts are described in U.S. Pat. Nos. 3,278,457, 3,941,849, 4,472,560, 5,158,922, 5,470,813, and 5,482,908.

Examples of a suitable base catalyst include alkaline-metal hydroxides, alkaline earth-metal hydroxides, Lewis bases, and double metal-cyanide complexes.

In another embodiment the polyoxyalkylene glycol may be prepared using a zinc hexacyanocobaltate-tert-butyl alcohol complex as disclosed in U.S. Pat. No. 6,821,308.

The reaction may be carried out a reaction temperature range of 50° C. to 150° C., or 100° C. to 120° C.

The reaction may be carried out at atmospheric pressure between 10 kPa to 3000 kPa (or 0.1 bar to 30 bar), or 50 kPa to 1500 kPa (or 0.5 bar to 15 bar).

The base catalyst may be removed or neutralised by techniques including acid neutralization, ion exchange, adsorption of metals, or mixtures thereof.

The initiator is typically water and/or an alcohol. The alcohol includes either a monohydric alcohol or a polyhydric alcohol. Examples of a suitable polyhydric alcohol include ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. Examples of a monohydric alcohol include methanol, ethanol, propanol, butanol, pentanol, hexanol, heptanol, octanol, 2-ethylhexanol, nonanol, decanol, undecanol, dodecanol, tridecanol, tetradecanol, pentadecanol, hexadecanol, heptadecanol, octadecanol, nonadecanol, eicosanol, or mixtures thereof.

In different embodiments linear monohydric alcohol includes methanol, butanol, or mixtures thereof. In particular linear monohydric alcohol includes butanol.

In a further embodiment the monohydric alcohol is linear and contains 1 to 40 carbon atoms. In one embodiment the monohydric alcohol is branched and contains 1 to 60 carbon atoms.

In a still further embodiment the monohydric alcohol is linear and contains 11 to 40 carbon atoms.

In another embodiment the monohydric alcohol is branched and contains 6 to 40 carbon atoms.

In different embodiments a suitable linear monohydric alcohol includes mixtures of $C_{12-15}$ alcohol, or $C_{8-10}$ alcohols, In still another embodiment the branched monohydric alcohols include 2-ethylhexanol, or isotridecanol, Guerbet alcohols, or branched alcohols of the Formula $R'R''CHCH_2OH$, or mixtures thereof.

Examples of suitable groups for R' and R" on the formula defined above include the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$polymethylene group, such as 2-$C_{1-15}$ alkyl-tetradecyl groups (e.g. 2-hexyltetradecyl, 2-decyltetradecyl and 2-undecyltridecyl) and 2-$C_{1-15}$alkyl-hexadecyl groups (e.g. 2-ethyl-hexadecyl and 2-dodecylhexadecyl);

3) alkyl groups containing $C_{10-12}$polymethylene group, such as 2-$C_{1-15}$ alkyl-dodecyl groups (e.g. 2-octyldodecyl) and 2-$C_{1-15}$alkyl-dodecyl groups (2-hexyldodecyl and 2-octyldodecyl), 2-$C_{1-15}$alkyl-tetradecyl groups (e.g. 2-hexyltetradecyl and 2-decyltetradecyl);

4) alkyl groups containing $C_{6-9}$polymethylene group, such as 2-$C_1$-15 alkyl-decyl groups (e.g. 2-octyldecyl and 2,4-di-$C_1$-15 alkyl-decyl groups (e.g. 2-ethyl-4-butyl-decyl group);

5) alkyl groups containing $C_{1-5}$polymethylene group, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio of 16:1-1:11) oligomers, isobutene oligomers (from pentamer to octamer), $C_{5-17}$ α-olefin oligomers (from dimer to hexamer).

In one embodiment the hydrocarbyl-capped polyoxyalkylene glycol in mono-capped.

The monohydric alcohol typically forms a capping group on the hydrocarbyl-capped polyoxyalkylene glycol.

In different embodiments the hydrocarbyl-capped group of the polyoxyalkylene glycol comprises a residue of a linear or branched monohydric alcohol containing 6 to 40, or 6 to 30, or 8 to 20 carbon atoms.

In other embodiments the hydrocarbyl-capped group of the polyoxyalkylene glycol comprises a residue of a branched monohydric alcohol containing 6 to 60, or 8 to 50, or 8 to 30, or 8 to 12 carbon atoms. The branching may occur at any point in the chain and the branching may be of any length.

Examples of a branched monohydric alcohol containing 6 or more carbon atoms include 2-ethylhexanol.

In different embodiments the hydrocarbyl-capped group of the polyoxyalkylene glycol comprises a residue of a linear monohydric alcohol containing 1 to 60, or 11 to 60, or 11 to 30, or 12 to 20, or 12 to 18 carbon atoms.

In still other embodiments the polyether may be a $C_1$-$C_8$ (typically butanol) monocapped polyalkylene glycol selected from the following compositions:

(i) 0 wt % to 40 wt % ethylene oxide (or ethylene glycol); and 60 wt % to 100 wt % propylene oxide (or propylene glycol);

(ii) 0 wt % to 20 wt % ethylene oxide (or ethylene glycol); and 80 wt % to 100 wt % propylene oxide (or propylene glycol);

(iii) 0 wt % to 10 wt % ethylene oxide (or ethylene glycol); and 90 wt % to 100 wt % propylene oxide (or propylene glycol);

(iv) 100 wt % propylene oxide (or propylene glycol); and (v) a block A-B-A type copolymer comprising 25 wt % to 40 wt % propylene oxide (or propylene glycol); 20 wt % to 50 wt % ethylene oxide (or ethylene glycol); and 25 wt % to 40 wt % propylene oxide (or propylene glycol).

In one embodiment the polyether is a homopolymer.

The distribution of molecular weight of the oil-soluble polyalkylene glycol is determined by GPC (gel permeation chromatography) using twelve polystyrene standards with peak molecular weights ranging from 350 to 2,000,000. The GPC uses columns described as (i) 3×PLgel 5 μm Mixed C (exclusion limit ~6M); 300×7.5 mm and (ii) 1×PLgel 5 100 Å 300×7.5 mm. The standard calibration has a correlation coefficient of greater than 0.998. The GPC uses a refractive index detector, a mobile phase of THF (tetrahydrofuran), and the column temperature is 40° C. The column setting is for a flow rate of 1 ml/min, injection volume of 300 μl; and sample concentration is 7.5 mg polymer to 1.0 ml THF.

Where the term distribution of molecular weight is applied to compositions having a distribution of molecular weight molecular weight it should be understood that the weight average molecular weight be within five percent of the reported nominal value for polyalkylene glycols with a reported value of less than 1000 g/mol, within 10% for reported values between 1000 and 7000 g/mol and within 12.5% for reported values greater than 7000 g/mol. For example, a polymer composition described as having a distribution of molecular weight of 3000 g/mol should be construed to literally cover compositions with a distribution of molecular weight ranging from 2625 g/mol to about 3375 g/mol. Similar methodology is disclosed in paragraph [0026] of International Publication WO 2007/089238 (Thompson et al., published 9 Aug. 2007).

The polyether described herein may have a distribution of molecular weight such that the molecules thereof have a weight of 1400 to 7000, or 3000 to 7000 Daltons.

The polyether compound of the present invention may comprise a component of a polyalkylene glycol that has 10 mole % to 100 mole %, or 20 mole % to 90 mole %, or 30 mol % to 80 mole %, or 40 mole % to 75 mole % within the weight of 2500 to less than 10,000 (or 2750 to 9000, or 3000 to 8000, or 3000 to 7000) Daltons as specified by the present invention.

Solvent

The solvent may be either an oil of lubricating viscosity or a hydrocarbon solvent (typically the solvent may be an oil of lubricating viscosity). The process may or may not include the presence of a hydrocarbon solvent other than oil. If present, hydrocarbon solvents can include aliphatic hydrocarbons or aromatic hydrocarbons. Examples of suitable aliphatic hydrocarbons include hexane, heptane, octane, nonane, decane, undecane, dodecane, tridecane and mixtures thereof. Examples of suitable aromatic hydrocarbons include benzene, xylene, toluene and mixtures thereof. In one embodiment the process requires a solvent other than or in addition to oil. In another embodiment the process of the invention does not include a hydrocarbon solvent.

Alcohol

Optionally the process described herein may contain an alcohol, or mixtures thereof. The alcohol may be a mono-ol or polyol. The mono-ol may be methanol in a mixture with at least one other alcohol. The polyol may be ethylene glycol, propylene glycol, or mixtures thereof. In one embodiment the process described herein further includes an alcohol, or mixtures thereof. The alcohol may be referred to as a promoter.

The alcohols include methanol and a mixture of alcohols containing 2 to 10, or 2 to 6, or 2 to 5, or 3 to 5 carbon atoms. The mixture of alcohols containing 2 to 7 carbon atoms can include branched or linear alkyl chains or mixtures thereof, although branched is typical The mixture of alcohols may contain ethanol, propan-1-ol, propan-2-ol, butan-1-ol, butan-2-ol, isobutanol, pentan-1-ol, pentan-2-ol, pentan-3-ol, isopentanol, hexan-1-ol, hexan-2-ol, hexan-3-ol, heptan-1-ol, heptan-2-ol, heptan-3-ol, heptan-4-ol, 2-ethylhexanol, decan-1-ol or mixtures thereof. The mixture of alcohols contains at least one butanol and at least one amyl alcohol. A mixture of alcohols is commercially available as isoamyl alcohol from Union Carbide or other suppliers.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group I, II, Group III, Group IV oil, or mixtures thereof. In another embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and U.S. Pat. No. 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetra-ethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium an overbased detergent.

Overbased detergents are known in the art. Overbased materials, otherwise referred to as overbased or superbased salts, are generally single phase, homogeneous Newtonian systems characterized by a metal content in of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 3.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulphides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

Extreme Pressure (EP) agents that are soluble in the oil include sulphur- and chlorosulphur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulphurised olefins (such as sulphurised isobutylene), a hydrocarbyl-substituted 2,5-dimercapto-1,3,4-thiadiazole, or oligomers thereof, organic sulphides and polysulphides such as dibenzyl-disulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclo-hexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptyl-phenol diacid; amine salts of alkyl and dialkylphosphoric acids or derivatives including, for example, the amine salt of a reaction product of a dialkyl-dithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37 ™ (FN 1380) and Exxon Mineral Seal Oil™ (FN 3200).

INDUSTRIAL APPLICATION

The lubricating composition of the present invention may be useful in an internal combustion engine, a driveline device, a hydraulic system, a grease, a turbine, or a refrigerant. If the lubricating composition is part of a grease composition, the composition further comprises a thickener. The thickener may include simple metal soap thickeners, soap complexes, non-soap thickeners, metal salts of such acid-functionalized oils, polyurea and diurea thickeners, calcium sulphonate thickeners or mixtures thereof. Thickeners for grease are well known in the art.

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In a further embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In another embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In a further embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

An engine lubricating composition may further include other additives. In one embodiment the invention provides a lubricating composition further comprising at least one of a dispersant, an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

In one embodiment an engine lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

An engine lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

The overbased detergent (other than the detergent of the present invention) may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

As used herein the term "soap" means the surfactant portion of a detergent and does not include a metal base, such as calcium carbonate. The soap term may also be referred to as a detergent substrate. For example, a phenate detergent soap or substrate is an alkylated phenol or a sulphur-coupled alkylated phenol, or a methylene-coupled alkylated phenol. Or for a sulphonate detergent, the soap or substrate is a neutral salt of an alkylbenzenesulphonic acid.

In one embodiment an internal combustion engine lubricating composition may have a soap content as delivered by detergents (including the detergent of the present invention)

may be in the range of 0.06 wt % to less than 1.4 wt %, or 0.1 wt % to less than 1 wt %, or 0.15 wt % to 0.9 wt % of the lubricating composition.

Typically the internal combustion engine lubricating composition may employ a detergent of the present invention, wherein the hydroxy-carboxylic acid may have at least two carboxylic acid groups such as tartaric acid.

Useful corrosion inhibitors for an engine lubricating composition include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

An engine lubricating composition in different embodiments may have a composition as disclosed in the following table:

| | Embodiments (wt %) | | |
|---|---|---|---|
| Additive | A | B | C |
| Product of Invention | 0.01 to 8 | 0.1 to 6 | 0.15 to 5 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0.1 to 15 | 0.1 to 10 | 0.2 to 8 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

The following examples provide illustrations of the invention. These examples are non-exhaustive and are not intended to limit the scope of the invention.

Examples

Preparative Additive A (ADD A)

A 3-liter, 4-necked flask fitted with a stirrer, thermometer, water reflux condenser, Dean stark condenser and a submerged gas inlet tube is charged with p-dodecylphenol (500 g) and heated to (80° C.). The heated phenol is then treated with Synalox® 100-120B, a propylene oxide homopolymer initiated with butanol having a molecular weight of 4176 Daltons as measured by GPC method described above (or a literature average molecular weight of 1800-2300) and commercially available from Dow Chemicals, (180 g). The reagents are further heated (93-100° C.) before addition of $Ca(OH)_2$ (45 g) followed by ethylene glycol (35 g). The reaction mixture is stirred 450 rpm) and heated to 123-124° C.; elemental sulphur (91.5 g) is added under nitrogen (1.0 cfh). The temperature of the reaction mixture is slowly ramped to 185° C. under nitrogen (1.0 cfh) and held at that temperature for a further 8 hours before cooling to 80° C., charging diluent oil (216 g; 22 wt %). After cooling to room temperature, the reaction mixture is heated to 90° C. with stirring (20 minutes) and decyl alcohol (65 g) and ethylene glycol (28 g) are charged. The reaction mixture is further heated to 99-100° C. for 10 minutes before additional $Ca(OH)_2$ (35 g) is added. The reaction mixture is then heated to 171° C. under nitrogen (1.0 cfh) for 3.0 hours, to remove the distillates before being heated to 220° C. for 30 minutes. The product is vacuum stripped (20 mmHg) at 220° C. for 1.0 hour and to remove any trace volatiles and filtered at 150° C. through filter aid. Yield: 810 g (82%)

Preparative Additive 2 (ADD B)

A 3-liter, 4-necked flask fitted with a stirrer, thermometer, water reflux condenser, Dean stark condenser and a submerged gas inlet tube is charged with p-dodecylphenol (PDDP) (500 g) and heated to (80° C.). The PDDP is further heated (93-100° C.) before addition of $Ca(OH)_2$ (45 g) followed by ethylene glycol (35 g). The reaction mixture is stirred (450 rpm) and heated to 123-124° C. and elemental sulphur (91.5 g) is added under nitrogen (1.0 cfh) The temperature of the reaction mixture is slowly ramped to 185° C. under nitrogen (1.0 cfh) and held at that temperature for a further 8 hours before cooling to 80° C., charging diluent oil (216 g; 21 wt %) and finally cooling to room temperature overnight. The reaction mixture is heated to 90° C. with stirring (20 minutes), and decyl alcohol (65 g), ethylene glycol (28 g) and Synalox 100-120B (215 g) are charged to the reactor. The reaction mixture is further heated to 99-100° C. for 10 minutes and additional $Ca(OH)_2$ (35 g) is added. The reaction mixture is then heated to 171° C. under nitrogen (1.0 cfh) for 3.0 hours, to remove the distillates and is then heated to 220° C. for 30 minutes. The product mixture is vacuum stripped (20 mmHg) at 220° C. for 1.0 hour and to remove any trace volatiles, cooled to 150° C., and filtered through filter aid. Yield: 835 g (85%).

Preparative Additive C (ADD C) (Comparative)

In an 8-oz jar, an oil-diluted calcium containing sulphur-coupled phenate detergent (5.2% Ca; 145 TBN; 27% Oil) (100 g) and Synalox 100-120B (20 g) are mixed thoroughly and placed in an oven at 80° C. for 30 minutes. The mixture is stirred every 30 minutes for 5 minutes over the course of a 6 hour period and then cooled to room temperature.

Preparation of Neutral Detergent Precursor (NDP)

A 51 flange flask equipped with a thermowell/thermocouple, a condenser, and a sub-surface gas inlet tube is charged with diluent oil (2048 g), alkyl alcohols (147.2 g), succinated polyisobutylene (polyisobutylene has Mn of about 1000) (147.2 g) and lime (100 g). The reaction is stirred (500 rpm) at room temperature (20° C.); nitrogen is bubbled through the reaction (l cfh) and a mixture of calcium chloride (6.2 g) and water (8.88 g) are added. Alkylbenzenesulphonic acid (926 g) is added over 20 minutes ensuring the reaction temperature remains below 50° C. After the addition is complete the reaction is heated to 100° C. and stirred (700 rpm) at that temperature for 1 hour 20 minutes. The reaction apparatus is heated to 150° C. and stirred for 10 minutes. The flask is then cooled to room temperature overnight, reheated to 100° C., and decanted into a jar.

Preparative Additive D (ADD D)

NDP (798 g) is charged to a 3 l flange flask. Neutral calcium phenate (69% oil, 2.2 wt % calcium) (33.1 g) is added and the flask is equipped with a mechanical stirrer, a sub-surface gas inlet, a thermowell/thermocouple, and a water condenser. A solution of methanol (76.4 g), C4-C6 alcohol mixture (131 g) and water (4.2 g) is added followed by Synalox 100-120B (132.9 g). A first lime charge (60.6 g) is added and the reaction mixture warmed to 48° C. After the lime is fully dispersed, carbonation is commenced while controlling any exotherm with compressed air. Base number is measured at intervals during the reaction. When the Base Number is approximately 40, an additional lime charge is added (60.6 g) and further carbonation is carried out; this process is repeated until 6 total lime additions are complete (364 g total lime). The reaction mixture is heated to 150° C. and held at this temperature for 30 minutes, the flask is cooled to 85° C. with compressed air and then allowed to cool to room temperature. Filter aid is added to the flask, and the product mixture is dissolved in toluene (1400 mL) at 85° C. and filtered through a pad of filter aid. Toluene is then removed by distillation.

Preparative Additive E (ADD E)

ADD E is prepared in a similar fashion to ADD D above, with the substitution of Brij® L4 (132.9 g) in place of the Synalox polyether. The Brij polyalkylene glycol (available from Aldrich Chemicals) is a monohydric tetramer of ethylene glycol with a dodecyl ether end group.

Preparative Additive F (ADD F)

NDP (815 g) is charged to a 3 l flange flask. Neutral calcium phenate (33.1 g) is added and the flask is equipped with a mechanical stirrer/teflon stirrer guide, a sub-surface gas inlet, a thermowell/thermocouple, and a water-cooled condenser. A solution of methanol (76.4 g), C4-C6 alcohol mixture (131 g), and water (4.2 g) is added to the reaction flask and the temperature is raised to 48° C. PEG 200 (polyethylene glycol with Mw of ~200) (11.65 g) is added followed by the first lime charge (61.74 g). The reaction mixture is stirred at 1000 rpm for 10 minutes to fully disperse the lime. When the measured base number of the reaction mixture is 40, the second batch of lime and PEG 200 are added and a further carbonation reaction is carried out. The remaining lime and PEG 200 additions are carried out in a similar fashion. The lime and polyether are added in six batches (370 g total lime; 69.9 g total polyether). After the sixth carbonation, the reaction product is heated to 150° C. and held at this temperature for 30 minutes. The reaction mixture is cooled to 85° C. with compressed air and then allowed to cool to room temperature. Filtration of the product mixture with filter aid is carried out at 95° C.

Additives G through L are prepared in a similar fashion as ADD F and are summarized in Table 1 below.

Additive M (ADD M)

3 l flange flask is charged with succinated polyisobutylene (PIBSA) (polyisobutylene has Mn of about 1000) (73.7 g), para-dodecyl phenol (50.3 g), alkyl benzene sulphonic acid (212.4 g) and dil oil (413 g). The flask is equipped with a 5 necked lid, mechanical stirrer, submerged gas inlet tube, thermowell/thermocouple and a dogleg leading to a condenser. The remaining port is stoppered. The mixture is warmed to 50° C. and (aq) sodium hydroxide (50% w/w, 61.4 g) is added slowly keeping the temperature below 85° C. (max temp 65° C.). The mixture is then heated to 86° C. with a flow of $N_2$ (0.5 cfh) and stirred for one hour before being cooled to room temperature. The mixture is heated to 152° C. with a flow of $N_2$ (0.5 cfh) and stirred for 15 minutes. The distillation set up is exchanged for a Dean-Stark apparatus and the mixture heated to 156° C. The first increment of sodium hydroxide flakes (111 g) are added followed by Brij L4 (34 g) and the mixture stirred for 5 minutes before carbon dioxide gas, about 120 g, is blown through the reaction mixture over 40 minutes. This process is repeated for the remaining 3 sodium hydroxide and Brij L4 additions (444 g total sodium hydroxide, 137 g total polyether). After the last carbonation is complete, the Dean-Stark apparatus is removed and a distillation set up added. The reaction mixture is heated to 156° C. under a vacuum (20 mmHg) and stirred for 30 minutes before being allowed to cool room temperature. The solids content is determined to be 2%. FAX-5 (100 g) is weighed out and half used to set up a pad with the remaining portion added to the reaction flask and stirred at 85° C. The filtration took 4 hours (lamp).

Additives N to P are in a similar fashion to ADD M modifying the reagents as summarized in Table 1 below.

Preparative Additive Q (ADD Q)

A 2 L flask is charged with PDDP (400 g) and heated to 100° C. Calcium hydroxide (23.3 g) and ethylene glycol (8.6 g) are added and the mixture is heated to 124° C. Sulphur (72.8 g) is charged and the mixture is heated to 171° C. for 5 hours. The mixture is diluted with diluent oil (99.5 g) and cooled to room temperature. Ethylene glycol (113.5 g), Synalox 100-120B (129 g) and decanol (141.1 g) are charged, followed by alkylbenzene sulphonic acid (35.5 g) and calcium hydroxide (186.8 g). The mixture is heated to 168° C. for 1 hour. Carbon dioxide is introduced for 1 hour at 1.8 cfh. Diluent Oil (354 g) is added and the mixture is heated to 210° C. and held at that temperature for 1 hour while applying a 28" Hg vacuum. After the vacuum is released, PIBSA (65.4 g) is added and the mixture is cooled to 130° C. Filtration over filter aid yields the final product.

Preparative Additive R (ADD R)

A 2 L flask is charged with PDDP (403 g) and heated to 100° C. Calcium hydroxide (23.3 g), Synalox 100-120b (127.3 g) and ethylene glycol (8.6 g) are added and the batch is heated to 124° C. Sulphur (73 g) is charged and the mixture is then heated to 171° C. for 5 hours. The mixture is diluted with diluent oil (106 g) and cooled to room temperature. Ethylene glycol (112 g), and decanol (141.1 g) are charged, followed by alkylbenzene sulphonic acid (38 g) and calcium hydroxide (186.8 g). The batch is heated to 168° C. for 1 hour. Carbon dioxide is introduced for 1 hour at 1.85 cfh. Diluent Oil (354 g) is added and the mixture is heated to 210° C. and held at temperature for 1 hour under a 28" Hg vacuum. After releasing the vacuum, PIBSA (64 g) is added and the mixture is cooled to 130° C. Filtration over filter aid yields the final product.

TABLE 1

| Preparative Examples | | | | | | |
|---|---|---|---|---|---|---|
| | Substrates | Polyether | % PE | % Metal | % Substrate[1] | TBN |
| ADD A | Ca Phenate | Synalox 100-120B ® | 18 | 5.7 | 50 | 162 |
| ADD B | Ca Phenate | Synalox 100-120B ® | 21 | 5.1 | 50 | 144 |
| ADD C (comp) | Ca Phenate | Synalox 100-120B ® | 17 | 4.3 | 53 | 112 |
| ADD D | Ca sulphonate | Synalox 100-120B ® | 10 | 13.4 | 18 | 353 |
| ADD E | Ca sulphonate | Brij L4 ® | 10 | 14.5 | 18 | 362 |
| ADD F | Ca sulphonate | PEG 200 | 5 | 14.2 | 17 | 398 |
| ADD G | Ca sulphonate | PEG 200 | 10 | 13.8 | 16.3 | 380 |
| ADD H | Ca sulphonate | Synalox 100-120B ® | 10 | 13.4 | 16.3 | 392 |
| ADD I | Ca sulphonate | Brij L4 ® | 10 | 14.5 | 16.3 | 362 |
| ADD J | Ca sulphonate | PEEO 3/4[2] | 10 | 13.9 | 16.3 | 378 |
| ADD K | Ca sulphonate | PEEO 15/4[3] | 10 | 13.5 | 16.3 | 358 |
| ADD L | Ca sulphonate | UCON LB-285 ® | 10 | 13.8 | 16.3 | 355 |
| ADD M | Na sulphonate | Brij L4 ® | 10 | 16.3 | 17.3 | 420 |
| ADD N | Na sulphonate | UCON LB-285 ® [4] | 10 | 17.3 | 17.3 | 424 |
| ADD P | Na sulphonate | PEG 200 | 5 | 20.4 | 18 | 438 |
| ADD Q | Ca Phenate | Synalox 100-120B ® | 10 | 8.2 | 29 | 234 |
| ADD R | Ca Phenate | Synalox 100-120B ® | 10 | 8.5 | 29 | 224 |

[1]Calculated

[2]PEEO 3/4 - Pentaerythritol ethoxylate (3/4 EO/OH) available from Aldrich

[3]PEEO 15/4 - Pentaerythritol ethoxylate (15/4 EO/OH) available from Aldrich

[4] UCON LB-285 ® polyether - Polypropylene glycol ether with average Mw of 1020, available from Dow Chemical Company A set of 5W-30 engine lubricants suitable for use in diesel (i.e. compression ignition) engines are prepared in API Group III base oil of lubricating viscosity containing the additives described above as well as conventional additives including polymeric viscosity modifier, ashless succinimide dispersant, overbased detergents, antioxidants (combination of phenolic ester, diarylamine, and sulphurized olefin), zinc dialkyldithiophosphate (ZDDP), as well as other performance additives as follows (Table 2).

TABLE 2

| Lubricating Compositions for Diesel Engines | | | | |
|---|---|---|---|---|
| | CEX1 | CEX2 | EX3 | EX4 |
| Group III Base Oil | Balance to 100% | | | |
| Neutral Ca Phenate[1] | 1.9 | | | |
| ADD A | | | 1.9 | |
| ADD B | | | | 1.9 |
| ADD C (comp) | | 1.9 | | |
| Other Detergents[2] | 0.11 | 0.11 | 0.11 | 0.11 |
| ZDDP[3] | 0.45 | 0.45 | 0.45 | 0.45 |
| Antioxidant[4] | 1.8 | 1.8 | 1.8 | 1.8 |
| Dispersant[5] | 4.9 | 4.9 | 4.9 | 4.9 |
| Viscosity Modifier[6] | 1.2 | 1.2 | 1.2 | 1.2 |
| Additional additives[7] | 0.5 | 0.5 | 0.5 | 0.5 |

TABLE 2-continued

| Lubricating Compositions for Diesel Engines | | | | |
|---|---|---|---|---|
| | CEX1 | CEX2 | EX3 | EX4 |
| % Phosphorus | 0.046 | 0.046 | 0.046 | 0.046 |
| % Sulphur | 0.2 | 0.2 | 0.2 | 0.2 |

[1]145 TBN Ca Phenate with 27% oil; 5.2 wt % Ca

[2]Stabilizing amount of overbased Ca sulphonate and overbased Ca phenate

[3]Secondary ZDDP derived from mixture of C3 and C6 alcohols

[4]Alkylated diarylamine antioxidant

[5]Succinimide dispersant derived from high-vinylidene polyisobutylene (Mn ~1600)

[6]Hydrogenated Styrene-diene block copolymer

[7]Other additives include friction modifiers, corrosion inhibitors, foam inhibitor, and pour point depressant The lubricating compositions are evaluated in bench oxidation and corrosion bench tests.

The formulations are subjected to the Komatsu hot tube test (280° C.), which consists of glass tubes which are inserted through and heated by an aluminum heater block. The sample is pumped via a syringe pump through the glass tube for 16 hours, at a flow rate of 0.31 cm.sup.3/hr, along with an air flow of 10 $cm^3$/min. At the end of the test the tubes are rinsed and rated visually on a scale of 0 to 10, with 0 being a black tube and 10 being a clean tube.

The lubricants are evaluated in copper and lead corrosion test as defined in ASTM Method D6594. The amount of lead (Pb) and copper (Cu) in the oil at the end of test is measured and compared to the amount at the beginning of the test. Lower lead and/or copper content in the oil indicates decreased corrosion. The results of the corrosion and oxidation deposit bench tests are summarized below (Table 3).

TABLE 3

| Corrosion and Oxidative Deposits | | | | |
|---|---|---|---|---|
| ASTM D6594 | CEX1* | CEX2 | EX3 | EX4 |
| Cu ppm | 7 | 6 | 4 | 4 |
| Pb ppm | 105 | 104 | 62 | 88 |
| Komatsu Hot Tube Rating | 2.5 | 2 | 9 | 7 |

*Average of 2 tests

The results obtained indicate that the detergents prepared in the presence of a polyether compound outperformed analogous materials lacking the polyether compound as well as detergent blended with the same polyether compound. This improvement is evident in both copper corrosion and oxidation deposit testing.

An additional set of 5W-30 engine lubricants suitable for use in gasoline (i.e. spark ignition) engines are prepared in API Group III base oil of lubricating viscosity containing the additives described above as well as conventional additives including polymeric viscosity modifier, ashless succinimide dispersant, overbased detergents, antioxidants (combination of phenolic ester, diarylamine, and sulphurized olefin), zinc dialkyldithiophosphate (ZDDP), as well as other performance additives as follows (Table 4).

TABLE 4

| Lubricating Compositions for Gasoline Engines | | | | | | | |
|---|---|---|---|---|---|---|---|
| Group III Base Oil | CEX5 | EX6 | EX7 | EX8 | EX9 | EX10 | EX11 |
| | Balance to 100% | | | | | | |
| ADD D | | 1.16 | | | | | |
| ADD E | | | 1.16 | | | | |

TABLE 4-continued

| Lubricating Compositions for Gasoline Engines | | | | | | | |
|---|---|---|---|---|---|---|---|
| Group III Base Oil | CEX5 | EX6 | EX7 | EX8 | EX9 | EX10 | EX11 |
| | Balance to 100% | | | | | | |
| ADD G | | | | 1.16 | | | |
| ADD J | | | | | 1.16 | | |
| ADD K | | | | | | 1.16 | |
| ADD L | | | | | | | 1.16 |
| Calcium Detergents[1] | 1.16 | | | | | | |
| ZDDP[2] | 0.86 | 0.86 | 0.86 | 0.86 | 0.86 | 0.86 | 0.86 |
| Antioxidant[3] | 1.25 | 1.25 | 1.25 | 1.25 | 1.25 | 1.25 | 1.25 |
| Dispersant[4] | 2.12 | 2.12 | 2.12 | 2.12 | 2.12 | 2.12 | 2.12 |
| Viscosity Modifier[5] | 0.72 | 0.72 | 0.72 | 0.72 | 0.72 | 0.72 | 0.72 |
| Additional additives[6] | 0.82 | 0.36 | 0.36 | 0.36 | 0.36 | 0.36 | 0.36 |
| % Phosphorus | 0.071 | 0.071 | 0.071 | 0.071 | 0.071 | 0.071 | 0.071 |
| % Sulphur | 0.22 | 0.22 | 0.22 | 0.22 | 0.22 | 0.22 | 0.22 |

[1]Overbased calcium sulphonate detergents
[2]Secondary ZDDP derived from mixture of C3 and C6 alcohols
[3]Combination of phenolic and arylamine antioxidants
[4]Succinimide dispersant derived from polyisobutylene succinimide, wherein the polyisobutylene has Mn of about 2300
[5]Ethylene-propylene copolymer
[6]Includes friction modifier(s), foam inhibitor(s), pour point depressant(s), and corrosion inhibitor(s)

The lubricating compositions are evaluated in a bench oxidation test. Pressure Differential Scanning calorimetry (PDSC) is a test designed to measure the oxidative stability of a fluid by measuring the time interval before oxidation onset occurs. Higher numbers are indicative of better oxidative stability. The antioxidancy results are summarized below (Table 5)

TABLE 5

| Antioxidancy Bench Test | | | | | | | |
|---|---|---|---|---|---|---|---|
| | CEX5 | EX6 | EX7 | EX8 | EX9 | EX10 | EX11 |
| Onset Time (min) | 69 | 79 | 73 | 82 | 80 | 70 | 82 |

The results obtained indicate that the overbased sulphonate detergents prepared in the presence of a polyether compound exhibited improved oxidative stability as measured by PDSC onset time.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as optionally modified by the word 'about.' Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating an internal combustion engine comprising supplying to the internal combustion engine a lubricating composition comprising an oil of lubricating viscosity and a product obtained by at least one of:

(a) A process for preparing a metal-containing detergent that has incorporated into it a polyether compound, the process comprising the steps of:
  (i) Forming/providing a detergent substrate in the presence of a polyether compound; and
  (ii) Neutralising the detergent substrate of step (i) with a metal-containing base to form a neutral metal-containing detergent soap, or (b) A process for preparing a metal-containing detergent that has incorporated into it a polyether compound, the process comprising the steps of:
  (i) Forming/providing a detergent substrate;
  (ii) Contacting the detergent substrate of step (i) with a polyether compound; thereafter neutralizing the detergent substrate with a metal-containing base to form a neutral metal-containing detergent soap, or (c) A process for preparing a metal-containing detergent that has incorporated into it a polyether compound, the process comprising the steps of:
  (i) Forming/providing a detergent substrate; and
  (ii) Neutralising the detergent substrate of step (i) with a metal-containing base in the presence of a polyether compound to form a neutral metal-containing detergent soap, with the proviso that at least 50 mol % of the polyether compound is added before 75% of neutralizing is complete wherein polyether compound has a number average molecular weight of 1400 to 7000 Daltons and wherein the detergent substrate comprises a hydrocarbyl-substituted phenol, or a sulphur-bridged alkyl phenol, or a methylene coupled alkyl phenol forming a phenate detergent, wherein the weight ratio of the detergent substrate to polyether varies from 1.32 to 3.4 and wherein the product is present in the range of 0.01 to 8 wt % of the lubricating composition.

2. The method of claim 1, wherein the process further comprises the step of (iii) overbasing the neutral metal-containing detergent soap to form an overbased detergent.

3. The method of claim 1, wherein the metal-containing base is a hydroxide or oxide of the metal.

4. The method of claim 1, wherein the metal of the metal-containing base is an alkali metal or alkaline earth metal.

5. The method of claim 4, wherein the metal is calcium or magnesium.

6. The method of claim 5, wherein the metal-containing base is calcium hydroxide, calcium oxide, or mixtures thereof.

7. The method of claim 1, wherein the polyether compound is a polyalkylene oxide or derivative thereof.

8. The method of claim 1, wherein the polyether compound is hydroxyl-terminated.

9. The method of claim 1, wherein the polyether compound is a C1-C8 monocapped polyalkylene oxide selected from the following compositions:

(i) 0 wt % to 40 wt % ethylene oxide (or ethylene glycol); and 60 wt % to 100 wt % propylene oxide (propylene glycol);

(ii) 0 wt % to 20 wt % ethylene oxide (or ethylene glycol); and 80 wt % to 100 wt % propylene oxide (propylene glycol);

(iii) 0 wt % to 10 wt % ethylene oxide (or ethylene glycol); and 90 wt % to 100 wt % propylene oxide (propylene glycol);

(iv) 100 wt % propylene oxide (propylene glycol); and (v) a block A-B-A type copolymer comprising 25 wt % to 40 wt % propylene oxide (or propylene glycol); 20 wt % to 50 wt % ethylene oxide (or ethylene glycol); and 25 wt % to 40 wt % propylene oxide (or propylene glycol).

10. The method of claim 1, wherein when the metal-containing detergent is a sulphonate, and the weight ratio of the polyether to detergent substrate varies from 1:50 to 5:2.

11. A method of lubricating an internal combustion engine comprising supplying to the internal combustion engine a lubricating composition comprising an oil of lubricating viscosity and a metal-containing detergent that has incorporated into it a polyether compound, obtained by the process comprising the steps of:

(i) Forming/providing a detergent substrate;

(ii) Neutralizing the detergent substrate of step (i) with a metal-containing base to form a neutral metal-containing detergent soap; and (iii) overbasing the neutral metal-containing detergent soap of step (ii) to form an overbased detergent, in the presence of a polyether compound, with the proviso that at least 50 mol % of the polyether compound is added before 75% of overbasing is complete wherein polyether compound has a number average molecular weight of 1400 to 7000 Daltons and wherein the detergent substrate comprises a hydrocarbyl-substituted phenol, or a sulphur-bridged alkyl phenol, or a methylene coupled alkyl phenol forming a phenate detergent, wherein the weight ratio of the detergent substrate to polyether varies from 1.32 to 3.4 and wherein the product is present in the range of 0.01 to 8 wt % of the lubricating composition.

12. The method of claim 11, wherein the metal of the metal-containing base is an alkali metal or alkaline earth metal.

13. The method of claim 12, wherein the metal is calcium or magnesium.

14. The method of claim 13, wherein the metal-containing base is calcium hydroxide, calcium oxide, or mixtures thereof.

15. The method of claim 11, wherein the polyether compound is a polyalkylene oxide or derivative thereof.

16. The method of claim 15, wherein the polyether compound is hydroxyl-terminated.

* * * * *